US008414220B1

(12) United States Patent
Koba

(10) Patent No.: US 8,414,220 B1
(45) Date of Patent: Apr. 9, 2013

(54) APPARATUS FOR FLATTENING FLOOR

(75) Inventor: Yoshiyuki Koba, Fukuoka (JP)

(73) Assignee: Josei Techno Co., Ltd., Fukuoka (JP)

( * ) Notice: Subject to any disclaimer, the term of this patent is extended or adjusted under 35 U.S.C. 154(b) by 0 days.

(21) Appl. No.: 13/369,485

(22) Filed: Feb. 9, 2012

(51) Int. Cl.
*E01C 19/24* (2006.01)
*E01C 19/28* (2006.01)

(52) U.S. Cl. ..... 404/117; 404/118; 404/123; 404/131

(58) Field of Classification Search ..... 404/117, 404/118, 120, 123, 131
See application file for complete search history.

(56) References Cited

U.S. PATENT DOCUMENTS 2,133,173 A * 10/1938 Meyer ..... 404/123
2,133,862 A * 10/1938 Kerns ..... 404/117
3,421,420 A * 1/1969 Piatkowski ..... 404/117
3,698,293 A * 10/1972 Wagner ..... 404/122
3,871,788 A * 3/1975 Barsby ..... 404/117
4,043,738 A * 8/1977 Modesto et al. ..... 425/456
4,219,287 A * 8/1980 Marks ..... 404/117
4,861,188 A * 8/1989 Rouillard ..... 404/75
6,200,066 B1 * 3/2001 Humphrey ..... 404/117
6,350,083 B1 * 2/2002 Paladeni ..... 404/118
6,409,425 B1 * 6/2002 Okabe et al. ..... 404/117
6,679,652 B2 * 1/2004 Suriano ..... 404/97
7,524,138 B2 * 4/2009 Koba ..... 404/112

FOREIGN PATENT DOCUMENTS

JP 2005-307475 11/2005

* cited by examiner

*Primary Examiner* — Gary S Hartmann
(74) *Attorney, Agent, or Firm* — Wenderoth, Lind & Ponack, L.L.P.

(57) ABSTRACT

An apparatus for flattening a half-dry concrete floor includes a plurality of pressure rollers arranged such that axes of them are parallel with one another in an imaginary plane, a holder rotatably supporting the pressure rollers at opposite ends of the pressure rollers, an oscillation-transmitter formed integral with the holder for transmitting oscillation to the pressure rollers, and an oscillator for oscillating the oscillation-transmitter.

17 Claims, 6 Drawing Sheets

APPARATUS FOR FLATTENING FLOOR

BACKGROUND OF THE INVENTION

1. Field of the Invention

The invention relates to an apparatus for flattening a floor over which a fresh concrete or mortar has been just placed in a construction site for constructing a concrete floor in a building.

2. Description of the Related Art

A conventional process for constructing a concrete floor in a building generally includes steps of levelling a fresh concrete having been placed on a floor in a construction site, leaving the concrete a few hours to allow the concrete to be cured, uniformly pressurize and flatten the floor by means of an apparatus called a trowel, and manually finishing the concrete by those skilled in the art through the use of a planarizer. The trowel is of a type on which an operator rides.

However, it is difficult to completely flatten a concrete surface in the step of levelling the concrete, roughness (concave and convex portions in the range of ±about 5 to 8 millimeters) usually remains without being removed at a concrete surface before the concrete surface is flattened by means of a trowel. Since it is not possible to remove such roughness out of a concrete surface even by levelling the concrete floor by means of a trowel and/or finishing the concrete floor through the use of a planarizer, the roughness remains at a finished floor, resulting in degradation of floor quality.

As an apparatus used for curing a ground in a road construction site, there is well known a hand-guided type oscillation roller (for instance, see Japanese Patent Application Publication No. 2005-307475).

Furthermore, as an apparatus used for levelling a surface of interlocking blocks to be laid on a footway, there is known a finisher commercially available from Mikasa Industry Inc. in the tradename "Block Plate", for instance. FIG. 6 is a perspective view of the finisher "Block Plate".

As illustrated in FIG. 6, the finisher 60 includes a plurality of rollers 61 each having an outer surface composed of hard rubber, a main frame 62 rotatably supporting the rollers 61, a motor 63 mounted on the main frame 62, an oscillator 64 mounted on the main frame 62, and a handle 65.

Starting up the motor 63, the oscillator 64 driven by the motor 63 generates oscillation, which is transferred to the rollers 61 through the main frame 62. Bringing the finisher 60 onto blocks laid in a park or on a footway, an operator grips the handle 65 with the motor 63 being in operation to thereby move the finisher 60 forwardly or backwardly, with the result that surfaces of the blocks are almost leveled by virtue of the oscillation of the rollers 61.

The oscillation rollers suggested in Japanese Patent Application Publication No. 2005-307475 are suitable for further curing a road which is already hard. However, if the oscillation rollers move on a floor composed of half-dry concrete, the oscillation rollers would depress the concrete floor, and rapidly sink into the concrete. Thus, it is not possible to use the oscillation rollers to half-dry concrete. Specifically, the suggested oscillation rollers can be used on a hard road, but cannot be used on a place in which an operator's footprints may remain, such as a floor composed of half-dry concrete.

The finisher 60 of Mikasa Industry Inc. illustrated in FIG. 6 is designed to provide oscillation to blocks laid in a construction site during moving to thereby flatten surfaces of the blocks. Accordingly, the finisher 60 is suitable to flattening hard blocks, because they are not deformed by pressure and/or oscillation transferred thereto through the rollers 61. However, if the finisher 60 is brought onto a floor composed of half-dry concrete, the finisher 60 sinks into half-dry concrete in a short period of time, and hence, cannot work any more, similarly to the above-mentioned oscillation roller.

SUMMARY OF THE INVENTION

In view of the above-mentioned problems in the above-mentioned related art, it is an object of the present invention to provide an apparatus for flattening a concrete floor, which is capable of removing roughness at a surface of half-dry concrete to thereby flatten a surface of cured concrete, and preventing cured concrete from cracking.

The present invention provides an apparatus for flattening a floor, including a plurality of pressure rollers arranged such that axes of them are parallel with one another in an imaginary plane, a holder rotatably supporting the pressure rollers at opposite ends of the pressure rollers, an oscillation-transmitter formed integral with the holder for transmitting oscillation to the pressure rollers, and an oscillator for oscillating the oscillation-transmitter.

In operation, the apparatus in accordance with the present invention is brought onto a half-dry concrete floor to be flattened, and then, the oscillator is driven to provide oscillation to the oscillation-transmitter. As a result, the oscillation-transmitter is resonated and hence hard oscillated, and the oscillation is transferred to the pressure rollers through the holder to thereby cause the pressure rollers to hard oscillate. An operator is able to readily move the apparatus without causing the apparatus to sink into the half-dry concrete by providing a force directing perpendicularly to axes of the pressure rollers with the apparatus in which the pressure rollers are oscillating.

In such a way as mentioned above, an operator provides a horizontal force to the apparatus in which the oscillation-transmitter is oscillating to thereby move the apparatus in a direction in which the pressure rollers roll, and thus, roughness at a half-dry concrete floor is removed by virtue of high oscillation and pressure caused by the pressure rollers rolling on the half-dry concrete floor. Consequently, the concrete floor can be flattened without concave and convex portions, and steps. Furthermore, since the half-dry concrete is hard cured by virtue of oscillation and pressures caused by the pressure rollers, it is possible to prevent the cured concrete from cracking.

The number of the pressure rollers is not to be limited to a specific number. Any number of the pressure rollers may be selected in dependence on construction conditions. Taking operability, controllability, mobility and stock space into consideration, it is preferable to select three to five pressure rollers. If "two" is selected as the number of the pressure rollers, it would not be possible to remove roughness of a concrete floor, since the pressure rollers roll up and down along concave and convex portions, and steps of a concrete floor, resulting in remarkable deterioration in performance for flattening a concrete floor. If "six" or more is selected as the number of the pressure rollers, it would be possible to enhance floor-flattening performance, but there would be caused a demerit that the apparatus cannot avoid from being large in a size. Thus, three to five is preferable as the number of the pressure rollers.

The oscillator may be designed to have any structure as long as it can resonate the oscillation-transmitter. It is preferable that the oscillator oscillates the oscillation-transmitter at a natural frequency of the oscillation-transmitter.

The apparatus in accordance with the present invention may be designed to further include a planarizer which slidably makes contact with a floor after the pressure rollers have passed the floor. It is possible to flatten a concrete floor out of which roughness has been removed by the rotation of the pressure rollers, since the planarizer makes slide movement on the concrete floor, ensuring enhancement in the flattening performance.

The apparatus in accordance with the present invention may be designed to further include a brush which slidably makes contact with a floor before the pressure rollers pass the floor and/or after the pressure rollers have passed the floor. Since the brush is able to remove concave and convex portions of a concrete floor, for instance, footprints of workers, which are difficult to remove merely by the oscillating and pressurizing action of the rolling pressure rollers, by making slide movement on the concrete floor, ensuring enhancement in a quality of the cured concrete floor.

At least one of the pressure rollers may be water-permeable at an outer surface thereof.

There may be employed a net, a grid or a porous plate, for instance, for designing the pressure roller to be water-permeable at an outer surface.

By so designing, it is possible to enhance the performance of removing roughness of a concrete floor by means of the pressure rollers each of which is water-permeable at an outer surface thereof. Furthermore, since a pressure roller which is water-permeable at an outer surface thereof has a high frictional force with a half-dry concrete floor, the apparatus for flattening a half-dry concrete floor may be designed to be able to run by itself by designing the apparatus to further include a driver for rotating the pressure rollers.

It is preferable that a pressure at which the pressure rollers make contact with a floor to be flattened is set in the range of 0.2 kg to 0.4 kg both inclusive per one centimeter in an axial direction of the pressure rollers.

By setting the pressure in the above-mentioned range, it would be possible to achieve superior performance for flattening a half-dry concrete floor without deterioration in controllability of the apparatus. If the pressure is set smaller than 0.2 kg/cm, a pressure at which the pressure rollers make contact with a concrete floor is weakened with the result of deterioration in the performance of removing roughness of a concrete floor. If the pressure is set higher than 0.4 kg/cm, high power is necessary for rolling the pressure rollers with the result of deterioration in controllability of the apparatus. Thus, it is preferable to set the pressure in the above-mentioned range.

The size of the pressure rollers is not to be limited to a specific size. The size of the pressure rollers may be determined considering mobility, a floor area of a construction site, operability and stock space. Considering the construction conditions having been experienced so far, it is preferable for the pressure rollers to have a length in the range of about 700 mm to about 2000 mm both inclusive and a diameter in the range of about 50 mm to about 200 mm both inclusive. If a construction site has a large floor area, and further, if there were no hindrance in operability and controllability of the apparatus, there may be used a pressure roller having a length over 2000 mm for enhancing a construction efficiency.

The oscillation-transmitter may be designed to include, for instance, a horizontally extending first plate, a second plate vertically extending from one of ends of the first plate, and a third plate vertically extending from the other end of the first plate, the second and third plates having the same vertical length as each other, and extending perpendicular to a direction in which the apparatus moves.

The advantages obtained by the above-mentioned present invention will be described hereinbelow.

The apparatus in accordance with the present invention makes it possible to remove roughness at a surface of half-dry concrete floor to thereby readily flatten or smooth the floor. In addition, the apparatus can prevent the concrete from cracking after the concrete was cured.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

A preferred embodiment in accordance with the present invention will be explained hereinbelow with reference to drawings.

Figure 1:
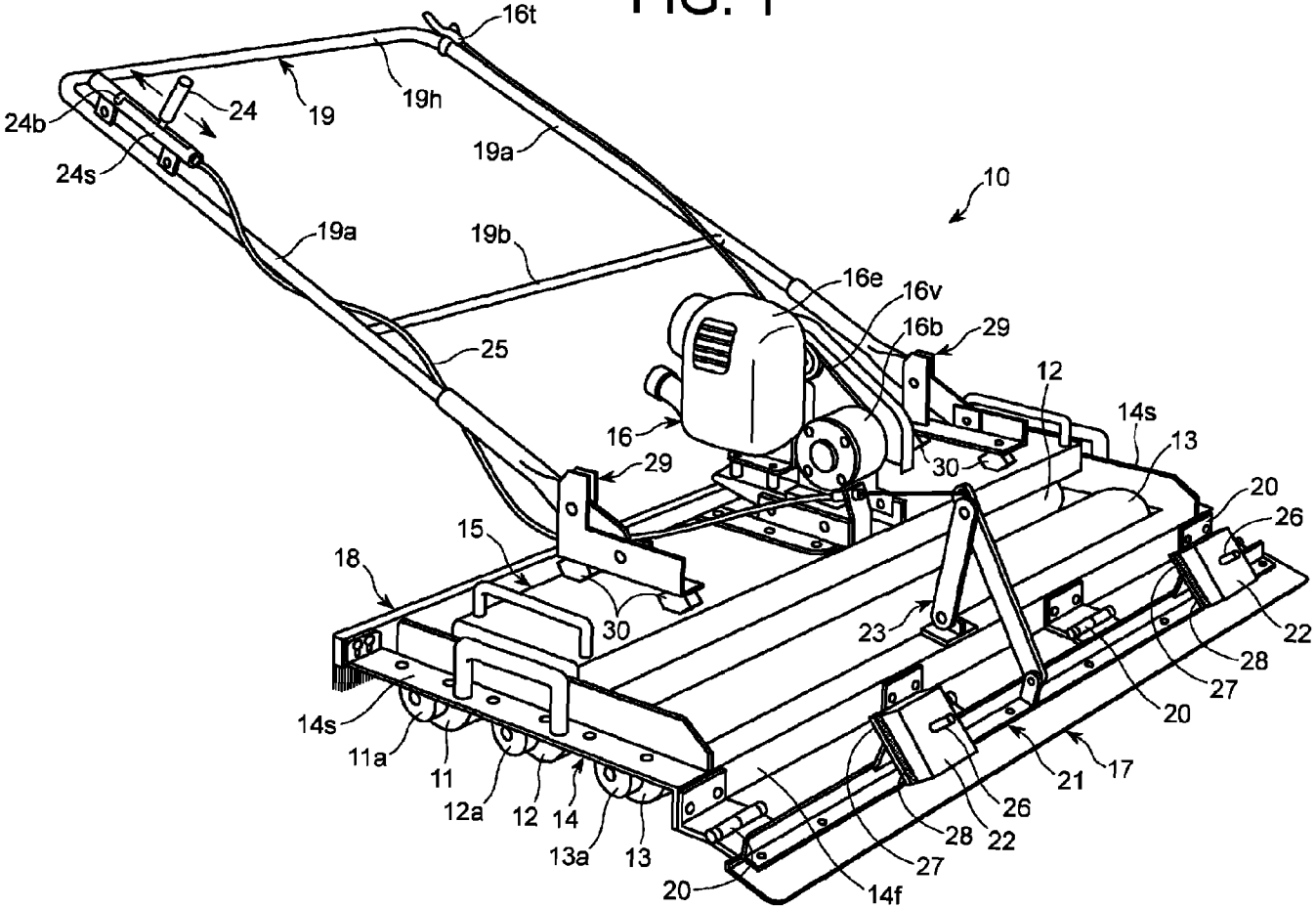
FIG. 1 is a front perspective view of the apparatus for flattening a half-dry concrete floor, in accordance with an embodiment of the present invention.
Figure 2:
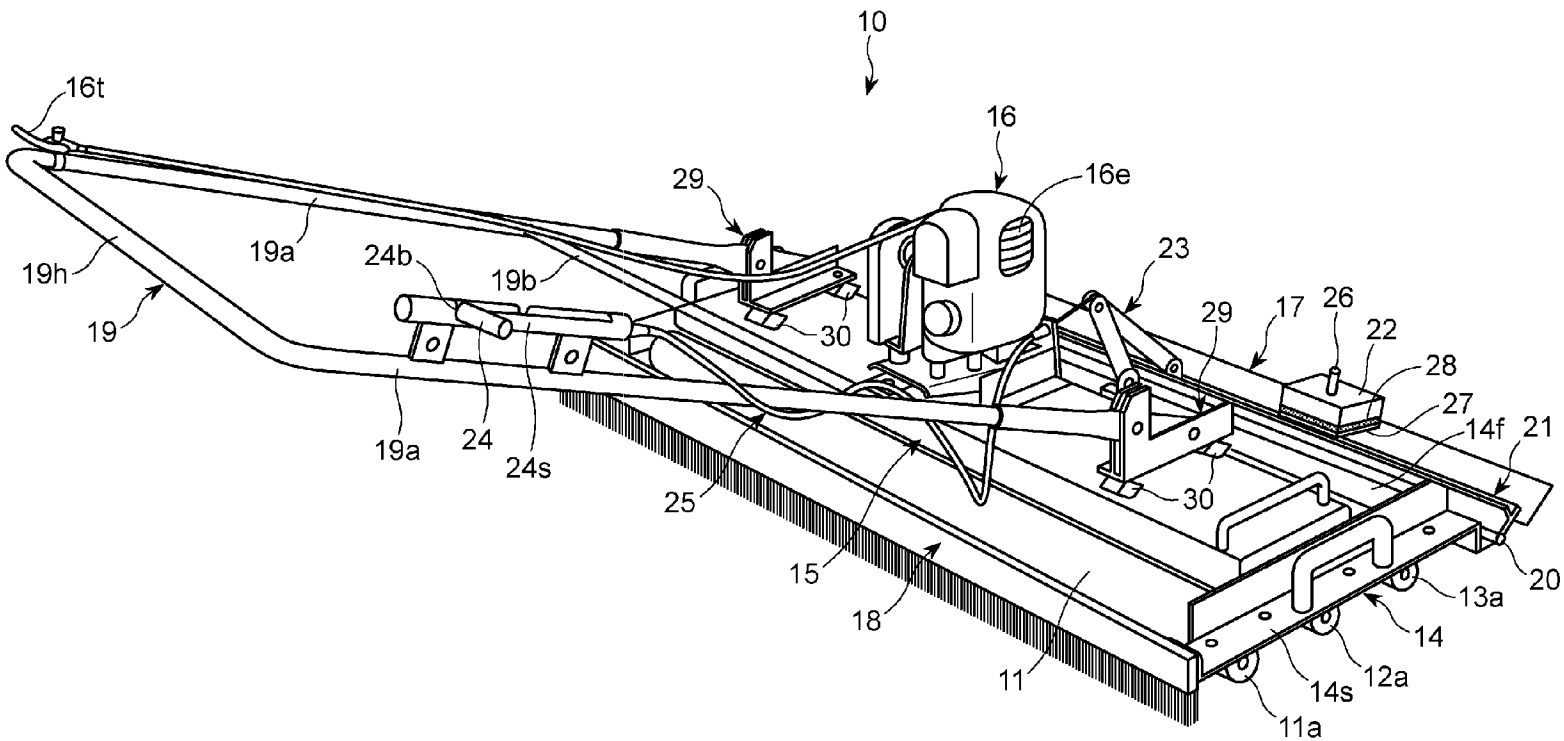
FIG. 2 is a rear perspective view of the apparatus illustrated in FIG. 1.
Figure 3:
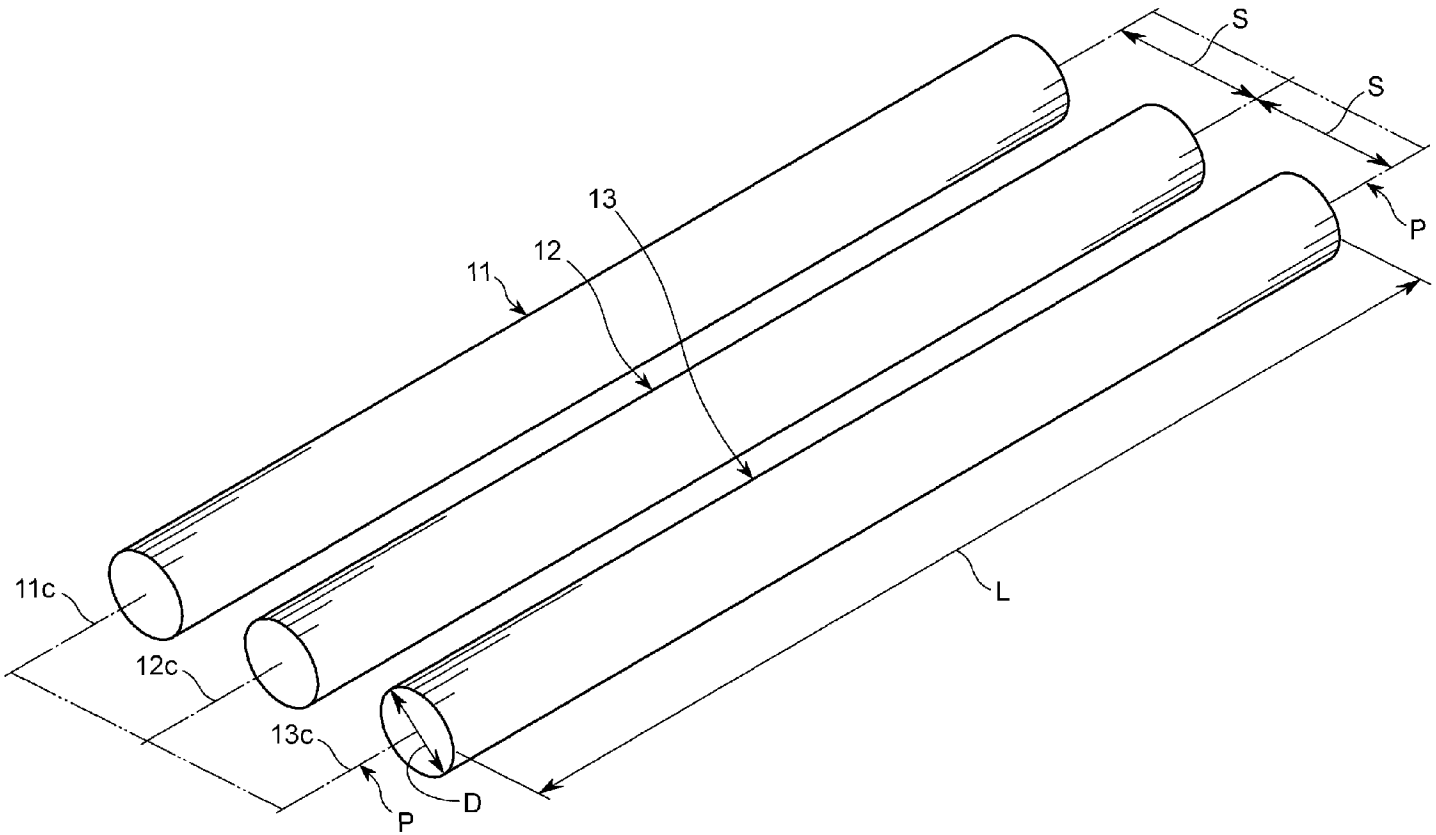
FIG. 3 is a perspective view illustrating the arrangement of pressure rollers which are one of parts defining the apparatus illustrated in FIG. 1.

As illustrated in FIGS. 1 to 3, the apparatus 10 for flattening a half-dry concrete floor, in accordance with the embodiment of the present invention, includes three pressure rollers 11, 12 and 13 arranged such that axes 11*c*, 12*c* and 13*c* of them are parallel with one another in an imaginary plane P, a holder 14 rotatably supporting the pressure rollers 11, 12 and 13 at opposite ends of the pressure rollers 11, 12 and 13, an oscillation-transmitter 15 formed integral with the holder 14 for transmitting oscillation to the pressure rollers 11, 12 and 13, an oscillator 16 mounted on the oscillation-transmitter 15 for oscillating the oscillation-transmitter 15 at a natural frequency of the oscillation-transmitter 15, a plate-shaped planarizer 17 which slidably makes contact with a half-dry concrete floor after the pressure rollers 11, 12 and 13 have passed the half-dry concrete floor, a brush 18 which slidably makes contact with the half-dry concrete floor before the pressure rollers 11, 12 and 13 pass the half-dry concrete floor, and a control handle 19 extending from an upper surface of the oscillation-transmitter 15.

The control handle 19 comprises a horizontal part 19*h* at which an operator grasps the control handle 19, connection parts 19*a* extending towards the oscillation-transmitter 15 from opposite ends of the horizontal part 19*h*, and a horizontal reinforcement part 19*b* extending between the connection parts 19*a*. The connection parts 19*a* are detachably connected at front ends thereof to L-shaped connectors 29 mounted on an upper surface of the oscillation-transmitter 15 through dampers 30.

In the apparatus 10, a direction in which the planarizer 17 exists is called "front", and a direction in which the brush 18 exists is called "rear". Top and bottom, and right and left are defined relative to an operator standing facing the oscillation-transmitter 15 at the rear of the control handle 19.

As illustrated in FIG. 3, the pressure rollers 11, 12 and 13 are cylindrical, composed of metal, have a smooth outer surface, and are identical in a size with one another. Each of the pressure rollers 11, 12 and 13 has the diameter D of 120 mm, and the length L of 1250 mm. The space S between adjacent pressure rollers is 175 mm. The apparatus 10 has a total weight of about 100 kg. A pressure at which the pressure rollers 11, 12 and 13 make contact with or compress a floor to be flattened is calculated to be about 0.27 kg per a centimeter in a direction of axes 11*c*, 12*c* and 13*c* of the pressure rollers 11, 12 and 13.

The figures mentioned above with respect to the apparatus 10 are just examples, and not to be limited to specific ones.

Figure 6:
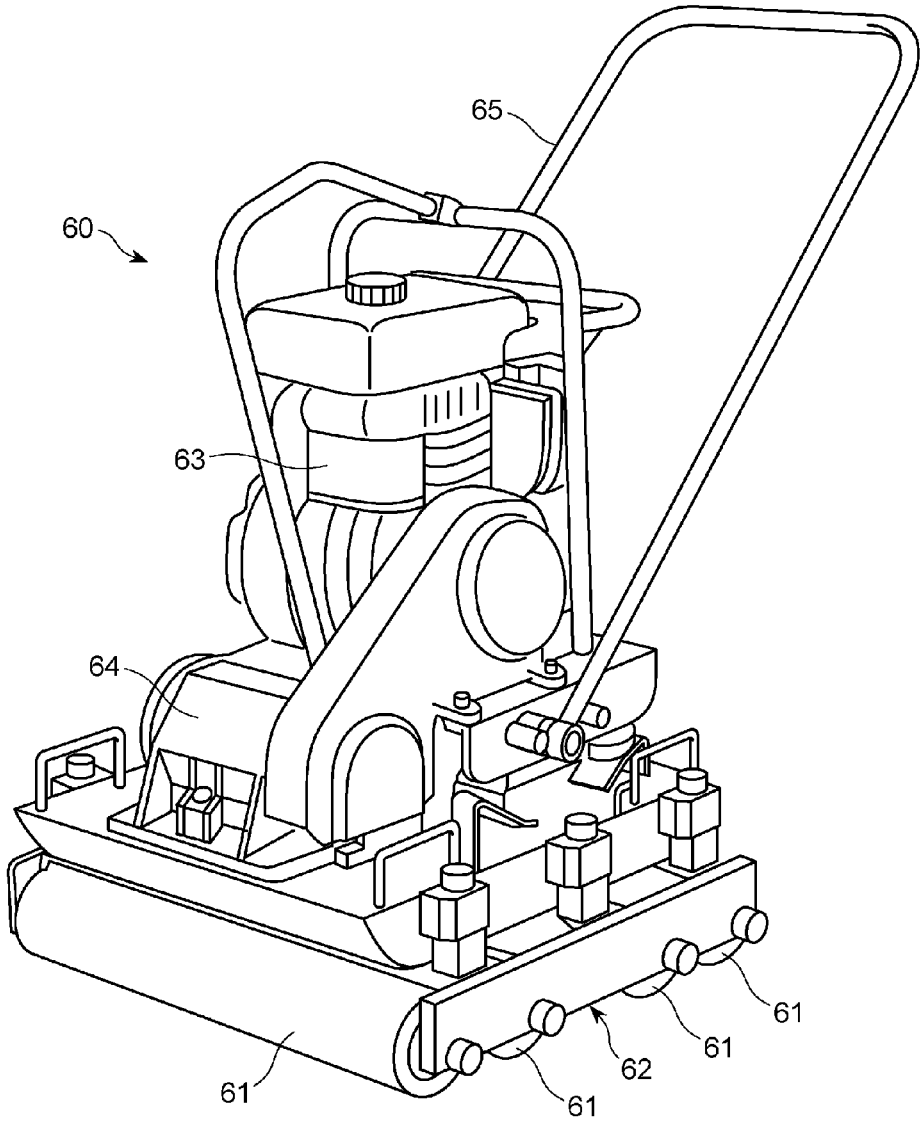
FIG. 6 is a perspective view of a conventional apparatus for flattening a floor.

In comparison, a pressure at which the rubber roller 61 in the conventional finisher 60 illustrated in FIG. 6 make contact with or compress a floor is calculated to be about 0.71 kg per a centimeter of the rubber roller 61.

Figure 5:
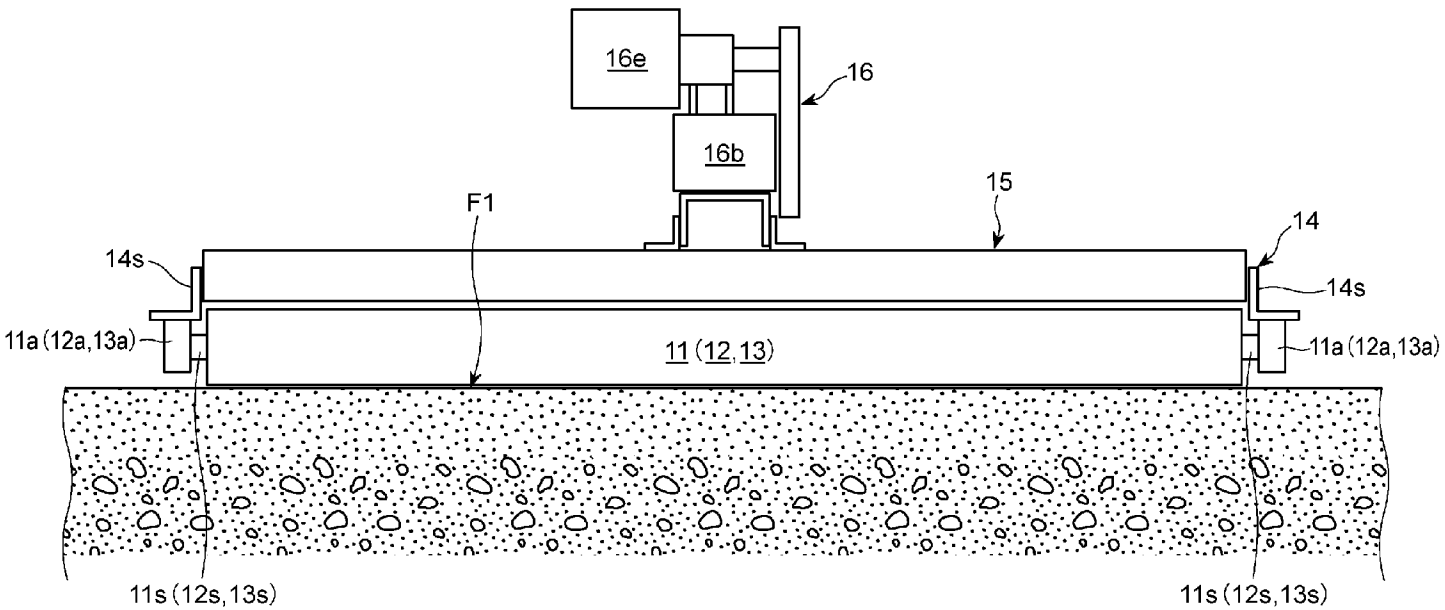
FIG. 5 is a front view of the oscillation system of the apparatus illustrated in FIG. 1.

As illustrated in FIG. 5, the pressure rollers 11, 12 and 13 are rotatably supported at a pair of side parts 14*s* of the holder 14 through both extended shafts 11*s*, 12*s* and 13*s* extended from the opposite ends of the pressure rollers 11, 12 and 13, and bearings 11*a*, 12*a* and 13*a*.

The holder 14 comprises a pair of side parts 14*s* (mentioned above), and a front part 14*f* extending between front ends of the side parts 14*s*. Looking down, the holder 14 is in the shape of "Π". The side parts 14*s* extend perpendicularly to the axes 11*c*, 12*c* and 13*c* of the pressure rollers 11, 12 and 13, and the front part 14*f* extend in parallel with the axes 11*c*, 12*c* and 13*c* of the pressure rollers 11, 12 and 13. Both the side parts 14*s* and the front part 14*f* are composed of an angle part having a L-shaped cross-section. As illustrated in FIG. 2, the length brush 18 extends between the side parts 14*s*, and are detachably attached to rear ends of the side parts 14*s*.

As illustrated in FIG. 1, the oscillator 16 includes a motor 16*e*, an oscillation generator 16*b*, and a belt 16*v* transferring a rotational forced generated by the motor 16*e* to the oscillation generator 16*b*. An eccentric rotor (not illustrated) included in the oscillation generator 16*b* is made rotate by the motor 16*e*, and resultingly, there is generated oscillation. The control handle 19 is equipped with a throttle lever 16*t* (see FIG. 1) for increasing or decreasing an output revolution number of the motor 16*e*. By handling the throttle lever 16*t*, oscillation output generated by the oscillation generator 16*b* can be controlled.

The oscillation-transmitter 15 has a cross-section in the shape of "Π" in a direction in which the pressure rollers 11, 12 and 13 roll, and is composed of metal plates having a thickness in the range of about 2 to about 5 mm. Specifically, the oscillation-transmitter 15 comprises a horizontally extending first plate, a second plate vertically extending from one of ends of the first plate, and a third plate vertically extending from the other end of the first plate. The second and third plates have the same vertical length as each other, and extend perpendicular to a direction in which the pressure rollers 11, 12 and 13 moves.

In brief, the oscillation-transmitter 15 is designed to be composed of a material and/or have a shape so as to readily make resonance in response to the oscillation generated by the oscillator 16.

A L-shaped reinforcement 21 is attached to the front part 14*f* of the holder 14 in front of and in parallel with the front part 14*f* through a plurality of hinges 20. The planarizer 17 is detachably attached to the reinforcement 21. The planarizer 17 is rotatable around the hinges 20 together with the reinforcement 21. The front part 14*f* of the holder 14 and the reinforcement 21 are connected with each other through a reverse-V-shaped link 23. A control wire 25 is engaged at a distal end thereof with the link 23, and further engaged at a proximal end thereof with a control lever 24 equipped with the control handle 19.

The control wire 25 is tensioned or relaxed by moving the control lever 24 forwardly or backwardly along a cylinder 24*s*, and accordingly, the planarizer 17 rotates around the hinges 20. In the present embodiment, when the control lever 24 is situated at a front of the cylinder 24*s* as illustrated in FIG. 1, the planarizer 17 lowers to thereby make contact with a floor, and when the control lever 24 is pulled backwardly along the cylinder 24*s*, and then, turned to the right such that the control lever 24 is fit at a proximal end thereof into an elongate opening of the cylinder 24*s*, as illustrated in FIG. 2, the planarizer 17 is locked in such a condition that the planarizer 17 moves up from a floor.

A pair of pillars 26 spaced away from each other and standing from the reinforcement 21 is equipped with a flange-shaped stopper 27 and a damper 28. A weight 22 is detachably attached onto an upper surface of each of the dampers 28. The weights 22 compress the planarizer 17 onto a floor. It is possible to control a compressive force of the planarizer 17 to a floor in dependence on the number of the weights 22 and/or a material of which the weights 22 are composed. The planarizer 17 is comprised of a plate composed of an elastically deformable metal, and accordingly, the planarizer 17 is able to elastically compress a floor in accordance with a weight of the weights 22.

Figure 4:
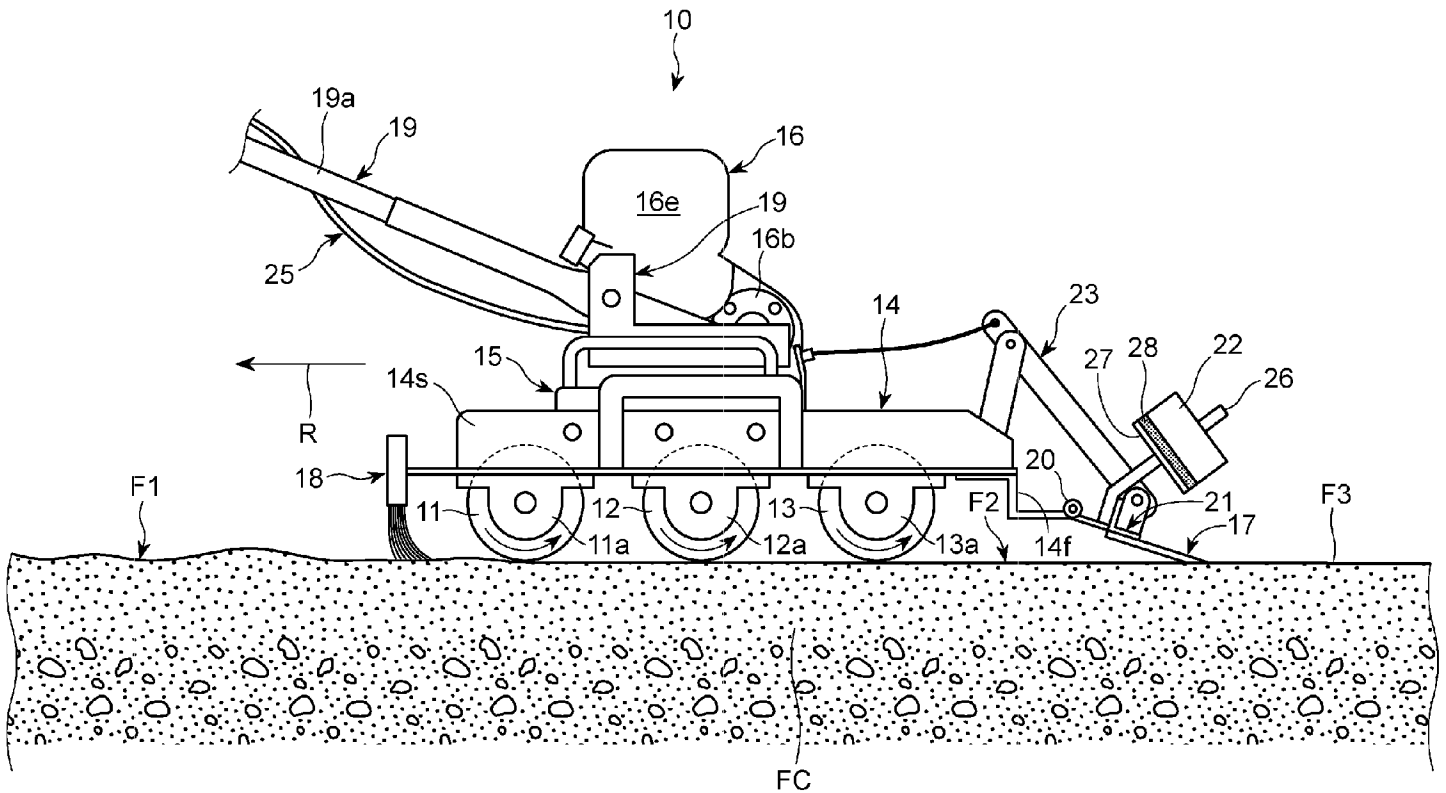
FIG. 4 is a side view of the apparatus illustrated in FIG. 1 with a part thereof being omitted.

In operation, as illustrated in FIG. 4, the apparatus 10 is brought onto a half-dry concrete floor F1 to be flattened. Then, the oscillator 16 is made start up, and the throttle lever 16*t* (see FIG. 1) is operated to thereby provide a natural frequency to the oscillation-transmitter 15. As a result, the oscillation-transmitter 15 resonates or fiercely oscillates, and the oscillation is transferred to the pressure rollers 11, 12 and 13 from the side parts 14*s* of the holder 14 through the bearings 11*a*, 12*a* and 13*a* and the extended shafts 11*s*, 12*s* and 13*s*.

Thus, through the pressure rollers 11, 12 and 13 also fiercely oscillate, since the apparatus 10 is kept on the floor without sinking into the half-dry concrete floor F1, the apparatus 10 moves in a direction in which the pressure rollers 11, 12 and 13 (a direction perpendicular to the axes 11*c*, 12*c* and 13*c* of the pressure rollers 11, 12 and 13) rotate when an operator applies a tensile force to the control handle 19 in a direction indicated with an arrow R. It is possible to find a specific position of the control lever 16*t* at which the oscillation-transmitter 15 fiercely oscillates by operating the throttle lever 16*t* to increase or decrease a revolution number of the motor 16*e*, and hence, the oscillation-transmitter 15 can be readily put into a condition in which the oscillation-transmitter 15 oscillates at a natural frequency thereof.

An operator applies a horizontal force (in a direction indicated with the arrow R) to the apparatus 10 in which the oscillation-transmitter 15 is oscillating at a natural frequency thereof, to thereby move the apparatus in a direction in which the pressure rollers 11, 12 and 13 rotate, and thus, as illustrated in FIG. 4, the pressure rollers 11, 12 and 13 oscillating while rolling on the half-dry concrete floor F1 compress the floor F1, ensuring that roughness at a surface of the half-dry concrete floor F1 is removed, and thus, the floor F1 can be flattened. Furthermore, since the half-dry concrete floor FC is hard cured by virtue of the oscillation and the compressive force caused by the pressure rollers 11, 12 and 13, it is possible to prevent the concrete floor from cracking after the concrete was cured.

The apparatus 10 in accordance with the present embodiment is designed to include the three pressure rollers 11, 12 and 13. However, the number of the pressure rollers is not to be limited to a specific number. Any number of the pressure rollers may be selected in dependence on construction conditions. Taking operability, controllability, mobility and stock space into consideration, it is preferable to select three to five pressure rollers.

In the apparatus 10 in accordance with the present embodiment, a pressure at which the pressure rollers 11, 12 and 13 make contact with the half-dry concrete floor F1 to be flattened is set to be 0.27 kg per a centimeter in a direction of the axes 11*c*, 12*c* and 13*c* of the pressure rollers 11, 12 and 13, ensuring it possible to achieve supreme performance of flattening a half-dry concrete floor without deteriorating the controllability of the apparatus 10.

Furthermore, the apparatus 10 is designed to include the planarizer 17 slidably making contact with a concrete floor F2 after the pressure rollers 11 to 13 have passed. Accordingly, the concrete floor F1 from which roughness was removed by virtue of the rolling of the pressure rollers 11, 12 and 13 is further flattened by means of the planarizer 17 making slide movement on a surface of the concrete floor F1, ensuring that a concrete floor F3 can be finished at a high level after the planarizer 17 has passed the floor F3.

While the planarizer 17 is moving in a direction indicated with the arrow R, the planarizer 17 compresses the concrete floor F2 by virtue of a compressive force caused by the weights 22. Since the planarizer 17 is rotatable around the hinges 20, the planarizer 17 can finish the concrete floor F2 without being affected by oscillation and/or rocking of the holder 14.

In addition, since the holder 14 is equipped at the rear thereof with the brush 18 slidably making contact with the half-dry concrete floor F1 before the pressure rollers 11, 12 and 13 pass, it is possible to remove convex and concave portions such as footprints of an operator, which are difficult to remove only by the rolling three pressure rollers 11, 12 and 13, by the brush 18 making slide movement on the floor F1. Accordingly, it is possible to enhance a quality of a finished floor, that is, the concrete floor F3.

The brush 18 may be designed to be arranged in front of the holder 14, for instance, at the front part 14*f*, in which case, the brush 18 slidably makes contact with the concrete floor F2 after the pressure rollers 11, 12 and 13 have passed the floor F2.

Since the brush 18 is detachably attached to the holder 14, the brush 18 may be taken off the holder 14 in dependence on construction conditions.

Furthermore, at least one of the pressure rollers 11, 12 and 13 may be designed to be water-permeable at an outer surface thereof. For instance, a net, a grid or a porous plate may be used for defining an outer surface of the pressure roller. By so designing, it is possible for the pressure roller which is water-permeable at an outer surface thereof to enhance the performance of removing roughness at a concrete floor. Furthermore, since the pressure roller which is water-permeable at an outer surface thereof has a high frictional force with a half-dry concrete floor, the apparatus 10 may be designed to be able to run by itself by designing the apparatus 10 to further include a driver for rotating the pressure rollers 11, 12 and 13.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2009-170496 filed on Jul. 21, 2009 including specification, claims, drawings and summary is incorporated herein by reference in its entirety.

What is claimed is:

1. An apparatus for flattening a half-dry concrete floor, the apparatus comprising:

a plurality of pressure rollers arranged such that axes of said pressure rollers are parallel with one another in an imaginary plane;

a holder rotatably supporting said pressure rollers at opposite ends of said pressure rollers;

an oscillation-transmitter connected to said holder for transmitting oscillation to said pressure rollers;

an oscillator for oscillating said oscillation-transmitter at a natural frequency of said oscillation-transmitter; and a planarizer including an elastically deformable plate, said planarizer slidably making contact with the floor, and being arranged behind said pressure rollers.

2. The apparatus as set forth in claim 1, further comprising a brush which is arranged in front of said pressure rollers, and slidably makes contact with the floor.

3. The apparatus as set forth in claim 1, wherein at least one of said pressure rollers is water-permeable at an outer surface thereof.

4. The apparatus as set forth in claim 2, wherein at least one of said pressure rollers is water-permeable at an outer surface thereof.

5. The apparatus as set forth in claim 1, wherein a pressure at which said pressure rollers make contact with the floor is in the range of 0.2 kg to 0.4 kg both inclusive per one centimeter in an axial direction of said pressure rollers.

6. The apparatus as set forth in claim 2, wherein a pressure at which said pressure rollers make contact with the floor is said floor to be flattened is set in the range of 0.2 kg to 0.4 kg both inclusive per one centimeter in an axial direction of said pressure rollers.

7. The apparatus as set forth in claim 1, wherein said oscillation-transmitter comprises a horizontally extending first plate having two ends, a second plate vertically extending from one of the ends of said first plate, and a third plate vertically extending from the other end of said first plate, and wherein said second and third plates have the same vertical length as each other, and extend in a direction parallel to the axes of said pressure rollers.

8. The apparatus as set forth in claim 2, wherein said oscillation-transmitter comprises a horizontally extending first plate having two ends, a second plate vertically extending from one of the ends of said first plate, and a third plate vertically extending from the other end of said first plate, and wherein said second and third plates have the same vertical length as each other, and extend in a direction parallel to the axes of said pressure rollers.

9. The apparatus as set forth in claim 1, further comprising a driver for rotating said pressure rollers.

10. The apparatus as set forth in claim 2, further comprising a driver for rotating said pressure rollers.

11. The apparatus as set forth in claim 1, wherein said planarizer is rotatable around a horizontal axis.

12. The apparatus as set forth in claim 11, further comprising:

a handle for moving said apparatus; and a control lever which controls a position of said planarizer, wherein said control lever is slidable relative to said handle to rotate said planarizer.

13. The apparatus as set forth in claim 1, further comprising at least one weight for compressing said planarizer onto the floor.

14. The apparatus as set forth in claim 13, further comprising a damper on which said at least one weight is arranged.

15. The apparatus of claim 1, wherein said oscillation-transmitter is formed integral with said holder.

16. The apparatus of claim 1, further comprising:

a pillar attached to said planarizer; and a weight disposed on said pillar for pressing said planarizer onto the floor.

17. The apparatus of claim 1, further comprising:

a pillar attached to said planarizer;

a weight disposed on said pillar for pressing said planarizer onto the floor; and a damper disposed on said pillar.

* * * * *